US005472770A

United States Patent [19]

Sato et al.

[11] Patent Number: 5,472,770

[45] Date of Patent: Dec. 5, 1995

[54] ABRASION RESISTANT PATTERN

[75] Inventors: Daisuke Sato, Nagoya; Nobuo Hirose, Toyokawa, both of Japan

[73] Assignee: 501 Fuji Toryo Co. Ltd., Aichi, Japan

[21] Appl. No.: 821,350

[22] Filed: Jan. 17, 1989

Related U.S. Application Data

[63] Continuation of Ser. No. 43,258, Apr. 27, 1987, abandoned.

[30] Foreign Application Priority Data

Apr. 28, 1986 [JP] Japan ..... 61-98583

[51] Int. Cl.[6] ..... D06N 7/04

[52] U.S. Cl. ..... 428/143; 428/148; 428/149; 428/150; 428/207; 428/217; 428/325; 428/330; 428/331; 428/402; 428/908.8

[58] Field of Search ..... 428/164, 143, 428/141, 148, 149, 150, 172, 207, 908.8, 210, 217, 325, 330, 331, 402, 409

[56] References Cited

U.S. PATENT DOCUMENTS

| | | | |
|---|---|---|---|
| 2,386,626 | 10/1945 | Nadeau et al. | 428/325 X |
| 3,551,197 | 12/1970 | Lindquist | 428/325 X |
| 4,560,615 | 12/1985 | Saito et al. | 428/698 X |
| 4,627,896 | 12/1986 | Nazmy | 428/698 X |

*Primary Examiner*—Donald J. Loney
*Attorney, Agent, or Firm*—Nims, Howes, Collison, Hansen & Lackert

[57] ABSTRACT

An abrasion resistant pattern is provided. This pattern is composed of a pattern and a paint film coated thereon, which film includes about 5% or more by volume of powder material having a New Mohs' hardness of 6 or more. This pattern can bear the repeated impact of the casting sand, and can be used to lower casting costs.

6 Claims, 2 Drawing Sheets

ABRASION RESISTANT PATTERN

This is a continuation of application Ser. No. 43,258 filed Apr. 27, 1987 for Abrasion Resistant Pattern, now abandoned.

BACKGROUND OF THE INVENTION

1. Field of the Invention

This invention relates to a pattern having superior abrasion resistance, and more particularly, to an improvement in the abrasion resistance of a pattern used in the production of a sandmold which is used as a mold for casting.

A sandmold is generally prepared by using a pattern, such as, for example, a wooden, synthetic resin, aluminium, or cast iron pattern. The pattern is liable to be subjected to great abrasion from the filler, including silica, and also from the casting sand when the sandmold is produced.

This invention concerns technology to decrease the abrasion and damage to the surface of a pattern caused by the filler, and to improve its durability.

2. Description of Prior Art

There have been introduced the following methods for improving the durability of the pattern for a sandmold:

(1) A method in which shellac or the like is coated on a pattern (page 92, Casting 1, published by Seibundo Shinkosha Co., Ltd., Jan. 31, 1966), and (2) A method in which a coating composed mainly of urethane is coated on a pattern (page 80, *A Casting Handbook*, published by the JAPAN FOUNDATION CASTING ASSOCIATION, May 20, 1973).

However, a pattern having superior durability has not been obtained, and only temporary protection of the surface has been obtained.

Further, a lubricative coating has been disclosed, in which the lubricative powder, for instance, molybdenum disulfide or the like, is added into the coating, and which powder is applied on a wooden pattern (Japanese Patent Publication No. 17568/73). However, this coating has aimed at improving, mainly by a lubricative effect, the drawing of a pattern from a sandmold and a pattern durable for repeated use for the long term has not been obtained.

Furthermore, there have been various other methods used before now. For instance, there has been used a method of applying chrome plating on a raw material to improve the abrasion resistance (Japanese Patent Publication No. 15006/69), or a method of flame coating of a ceramic material at a temperature of 1000° C. or more to provide a ceramic layer. However, both methods need a particular processing treatment, and whether these methods can be used or not depends on the inherent properties of the pattern or its shape.

SUMMARY OF THE INVENTION

It is an object of this invention to provide a pattern which can be used many times to prepare a sandmold. To attain this, a durable surface layer is formed, by using a usual coating method. This coating method is not only for patterns such as wooden or synthetic resin patterns, the heat stability of which is poor due to their own characteristics, but also on patterns such as an aluminum or cast iron, the heat resistance of which is inherently excellent. This method does not use a complex or severe pretreatment or processing treatment of the patterns.

It is another object of this invention to provide a pattern having longer durability by applying an ordinary coating method without applying the particular processing treatment such as those mentioned above, and without changing the properties of the raw material of the pattern. By this invention many sandmolds can be produced by one pattern, and this lowers the costs of producing sandmolds.

In one aspect of this invention, an abrasion resistant pattern is provided, which pattern has a surface layer comprising an achromatic dry paint film containing about 5% or more by volume of powder material having a New Mohs' hardness of 6 or more.

In another aspect of this invention, an abrasion resistant pattern is provided, which pattern has a surface layer comprising a chromatic dry paint film containing about 5% or more by volume of powder material that has a New Mohs' hardness of 6 or more.

According to this invention, abrasion resistance is given to a pattern without applying a complex or severe pretreatment on the pattern. Further, this pattern, having an abrasion resistant layer, can bear the repeated impact of the casting sand over a long term, and lowers casting costs.

DESCRIPTION OF THE PREFERRED EMBODIMENTS

Figure 1A:
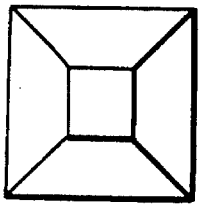
FIG. 1 is a plan view (A) and a side view (B) showing the shape of the pattern for a test to evaluate the effect of this invention.

According to this invention, a pattern having on its surface a dry paint film containing a certain value or more by volume of powder material having a New Mohs' hardness of 6 or more is provided.

A main component of the casting sand for producing the sandmold is quartz sand having a New Mohs' hardness of about 6, as indicated in Table 1, and a pattern is generally impacted by the casting sand under a squeezing pressure of about 7 to 14 Kg/cm$^2$.

TABLE 1

| Component | Weight |
|---|---|
| Medium size silica | 81.5–85 |
| Bentonite | 8.0–10 |
| Moisture | 2.8–3.5 |
| Quartz powder | 4.0–5 |
| Dextrin | 0.25–0.5 |

The casting sand, when impacted, not only impacts the surface of the pattern from various directions but also scratches it, so that these actions affect the pattern surface as powder friction. Therefore, it has been difficult to improve, by conventional countermeasures, resistance against abrasion.

However, the inventors of this invention have succeeded in inventing an abrasion-resistant pattern, by formulating a particular amount or more of powder material of the same or more of a New Mohs' hardness as that of the casting sand which is an impacting material, dispersing it in a coating, and applying the coating thus prepared on a pattern.

The values representative of the hardness of the powder material in this specification are based on values for a New Mohs' hardness, as given in Table 2, where the new and old values of Mohs' hardness are both described. The powder material in this specification means a large number of solid particles, between which a moderate force interacts, and which are dispersible in a coating.

TABLE 2

| Mohs' hardness | | |
|---|---|---|
| new | old | Name of Mineral |
| 1 | 1 | Talc |
| 2 | 2 | Gipsum |
| 3 | 3 | Calcite |
| 4 | 4 | Fluorite |
| 5 | 5 | Apatite |
| 6 | 6 | Feldspar |
| 7 | 6.5 | Quartz |
| 8 | 7 | Rock crystal |
| 9 | 8 | Topaz |
| 10 | 8.3 | Garnet |
| 11 | 8.7 | Zirconium oxide |
| 12 | 9 | Alumina |
| 13 | 9.3 | Silicon carbide |
| 14 | 9.6 | Boron carbide |
| 15 | 10 | Diamond |

Technology for providing a paint film having excellent weatherbility or corrosion resistance by formulating powder material in a coating is already known in the art, and various theoretical explanations have been made for these characteristics. However, no suggestion or teaching has been disclosed for technology providing paint film resistance against the impact or the scratching friction caused by powder material such as casting sand.

The durability of the paint film of the pattern of this invention is obtained by including a component giving effective wear resistance to the paint's film. This component is a powder material with a New Mohs' hardness equal to or more than that of the casting sand which is the impact material. Therefore, the coating, which forms a durable paint film of the pattern of this invention, differs from conventional coatings both in its structure and effect.

In contrast, conventional coatings generally use an easily pulverizable powder material having low values of a New Mohs' hardness in order to facilitate dispersion of pigment and to lower costs of the colorant, if the tinting strength of compared pigments is the same. Accordingly, a powder material having high values of Mohs' hardness has been rather unsuitable as a component of a paint film.

The inventors of this invention have succeeded in improving the durability of a paint film by formulating and dispersing in the paint film powder material of a New Mohs' hardness of 6 or more as a component to improve the abrasion resistance of the paint film.

In the examples of this invention, nitrocellulose, epoxy-modified acrylic resin, urethane resin, silicone acrylate resin, and fluororesin, are used as resin components to prepare the coating. However, resins that are ordinarily used for coatings, such as epoxy, acrylic, aminoalkyd, phenol, and vinyl resins, can also be used as a resin component in this invention.

The adhesion performance of a coating on an object generally depends on the condition of the object's surface or the kind of resin component. Similarly, the adhesion performance on the pattern substrate varies, depending on the kind of resin used to form paint films in this invention.

In this invention various resin components can be used to prepare an abrasion resistant coating, and this coating is applied on a pattern to form a highly abrasion resistant film. To further improve the durability of the film against friction, it is preferable to select a resin which is able to best adhere to the pattern substrate and to combine the selected resin with powder material to prepare a coating. The thus prepared coating is applied on a pattern to form a paint film on the surface of the pattern.

It has been found that the use of a powder of a New Mohs' hardness of 6 or more shows superior abrasion resistance, although the use of a powder material of a New Mobs' hardness of even 5 or less gives somewhat of the abrasion resistant effect. The inventors did not make experiments on powder of a New Mohs' hardness of 8, 9, 10, 14, or 15, due to the unavailability of corresponding powder materials. However, regarding the above powder materials, it is easily presumed, from the experimental results of the use of the powder materials, that satisfactory, abrasion resistance is obtained from the New Mohs' hardness of 6, 7, 11, 12 and 13.

The abrasion resistant effect appears increasingly when the added powder material in a paint film as a surface layer of a pattern exceeds a certain value. Actually, the abrasion resistant effect begins to appear when the added powder material reaches about 5% by volume in a dry paint film. An apparatus for producing a sandmold for use in a factory was used in the embodiment of this invention as a testing means to evaluate the durability of a pattern as stated below. The test results of the abrasion resistance were estimated by the number of shot times, which is indicative of the ability of a pattern to produce the sandmold.

A pattern, for example, having on it a chromatic dry paint film containing 5% by volume of feldspar, made from a Silicone acrylate resin coating, showed 400 shots, whereas a pattern having no paint film of this invention showed 100 shots. The number of shots gradually increases as the added powder material increases. However, when the added amount exceeds about 65% by volume, an effective paint film sustaining the friction cannot be formed, because the resin necessary to wet powder material is lacking (that is, a so-called critical pigment volume concentration is exceeded) and thus the adhesion force of the paint film to the pattern substrate lowers. Accordingly, the volume concentration of powder material in the paint film, as a surface layer of the model, is preferably about 65% or less.

The contents of the powder in the paint film on the surface of the pattern can be determined by stripping or cutting out a portion of the paint film from the pattern, and (1) dissolving the portion of the film in acetone and separating the powder material by a machine using centrifugal force to measure the weight of the powder material, or (2) igniting the portion of the paint film at 800°–1000° C. to measure the weight of the residue.

The separated powder material or the residue can be analyzed to identify its characteristics by an X-ray analyzer.

No particular relationship between the size and the durability of the pattern on which the paint film of this invention was coated was observed. However, it can be said that powder material having a particle size exceeding 200 microns (maximum particle size) is not preferable, because of possible loss of the dimensional accuracy of the pattern and because the smoothness of the paint film is reduced, and because the paint film is liable to induce a frictional resistance with the casting sand.

In the embodiment of this invention the thickness of the paint film forming a surface layer of the pattern was of generally 30 microns. The abrasion resistant effect can be expected to be enhanced when the thickness of the paint film is increased. However, a surface layer of the model having a thickness of about 200 microns will have a satisfactory durability.

The dispersion of the powder material in the coating to form the paint film of this invention may be that degree of dispersion obtained by means of an ordinary dispersing apparatus. By adding, for example, an antisedimentation agent or the like into the coating to prevent the sedimentation of the powder material, the uniform dispersion of the powder material can be maintained, which leads to the stabilized abrasion resistance of the paint film.

The durability of the paint film of this invention can be enhanced by combining resin or additives that are able to form a paint film, of a high toughness, with a coating.

A resin coating of a baking type can be used for a pattern substrate made of aluminium or other metals, and a coating of a cold hardening type can be used for pattern substrates made of wood or resin.

This invention will now be explained based on the embodiments.

In Tables 3–16, the formulations of the coatings for forming dry paint films as the surface layer of the patterns of this invention are listed Volume concentration % means the concentration of the powder material by volume in a dry paint film as the surface layer of the model. The volume concentration was calculated by the following formula:

$$\frac{\text{Volume of Powder Material in Surface Layer}}{\text{Volume of Resin Component in Surface Layer} + \text{Volume of Powder Material in Surface Layer}} \times 100 =$$

Volume concentration (%) of powder material in the surface layer, wherein the Surface Layer means the dry paint film on the surface of a pattern, Volume of the Powder Material is calculated from the added weight and the specific gravity of Powder Material, and the Volume of the resin component is calculated from the added weight and the specific gravity of the Resin Component.

Powder material, resin, and other additives, were given by parts by weight in the Table. An achromatic coating means a coating containing no colorant, and a chromatic coating means a coating containing a colorant.

Panastain (dyestuff: Fuji Toryo Co., Ltd.) was used as a colorant in the examples.

When a coating in which a colorant is added is used for forming the surface layer of the pattern, the color of the surface of the pattern gradually disappears, and the surface of the pattern substrate itself appears as the colored paint film detriorates from the impact of the casting sand. Accordingly, the colored paint film appearing as the surface layer can indicate the end of the duration of the abrasion resistant ability of the pattern. The colorant for these purposes may be of an organic or inorganic pigment, or a dyestuff of any color, provided that the surface of the pattern substrate itself can be observed after the detrioration or damage to the paint film.

The addition amount of the colorant may be an amount to perform the above object. The chromatic coating of this invention contains, about 2% by weight of Panastein in a coating.

A pattern having a surface layer of chromatic paint film formed from the chromatic coating can confirm the damage to the paint film in a sandmold production plant, as aforementioned. Therefore, the colored pattern can be repaired by recording the pattern to be used in further sandmold production, before the pattern itself becomes unusable and can raise the efficiency of production control by providing colored patterns for each type of product.

Modified Coating in the Table means coatings in which fluoro-modifier (Nippon Oil & Fats Co., Ltd. block copolymer; Japanese Early-Patent Publication No. 221410/75), or a silicone modifier (Toagosei Chemical Industry Co., Ltd. coating composition; Japanese Early-Patent Publication No. 164656/83) are added in small amounts to enhance the strength of the paint film.

The particle size and the specific gravity of the powder material used in the working examples are as follows:

| | Particle size | Specific gravity |
|---|---|---|
| Feldspar | 2 microns or less | 2.6 |
| Quartz | 5 microns or less | 2.6 |
| Zirconia | 1 microns or less | 5.6 |
| Alumina | 65 microns or less | 3.8 |
| Silicon Carbide | 65 microns or less | 3.2 |

These values of the particle size are approximate values obtained by sieve analysis.

Each coating for paint film was prepared in accordance with the usual method, depending on the kind of coating.

Powder was kneaded with resin solutions in a laboratory ball mill or a small-sized roller mill so as to be dispersed.

Figure 1B:
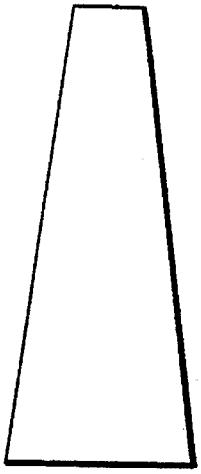

A pattern used in the example will now be explained by reference to FIG. 1.

This pattern is made of glass-fiber-reinforced epoxy resin to examine the effects of this invention. It is of a pyramid form, where a side of the square of the base is 5 cm, a side of the square of the top surface is 2 cm, and the height is 12 cm.

Formulating coatings in Tables 3–17 were coated on the above pattern by a spray gun, and dried, for drying time of the usual length, so as to prepare a dry paint film of a thickness of about 30 microns.

A thickness gauge for a dry film made by Byk-Chemie A. G. (Federal Republic of Germany) was used to measure the thickness of paint films.

Figure 2:
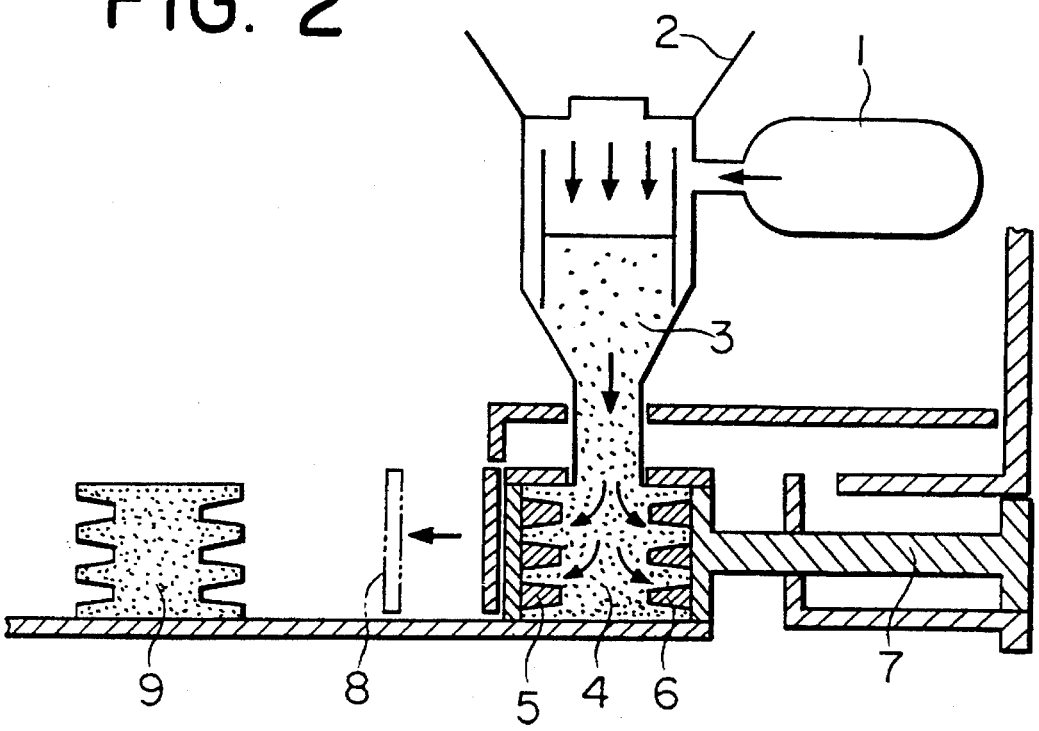
FIG. 2 is a partly sectional view schematically showing the action of the disamatic type molding machine used for evaluating the effect of this invention.

An apparatus of a disamatic type for producing sandmolds in a manufacturing plant was used to estimate the durability of a pattern, a schematic cross-sectional view of which apparatus is shown in FIG. 2. In this figure, reference number 1 indicates a compressed-air chamber, number 2 indicates a hopper, number 3 indicates casting sand, number 4 indicates a molding chamber, number 5 indicates formation of a front pattern, number 6 indicates the formation of a rear pattern, number 7 indicates an oil pressure cylinder, number 8 indicates a side plate for holding the front pattern while it is shifted to the left, and number 9 indicates a formed sandmold.

A method of testing the abrasion resistance used in the working examples will now be explained.

A glass fiber reinforced epoxy resin model was coated by the method mentioned above to form a surface layer as a dry paint film on the pattern. A plurality of coated epoxy resin patterns were assembled to make a front pattern 5 and a rear pattern 6 in a molding chamber 4 as shown in FIG. 2. Casting sand 3 having a composition as shown by. Table 1 was fed from the hopper 2 into the molding chamber 4 under a pressure of about 2 to 2.5 $Kg/cm^2$ by the compressed-air room 1. The casting sand was then compressed and squeezed in the molding chamber 4 under a pressure of about 7 to 14 $Kg/cm^2$ by the oil pressure cylinder 7. During compression, the surfaces of the patterns were subjected to the abrasion of the impact and/or scratching or similar force of the casting sand from various directions. The side plate 8 was then removed, and the formed sandmold 9 was pushed and thus separated from the front pattern, which implies the end of one operation.

Figure 3:
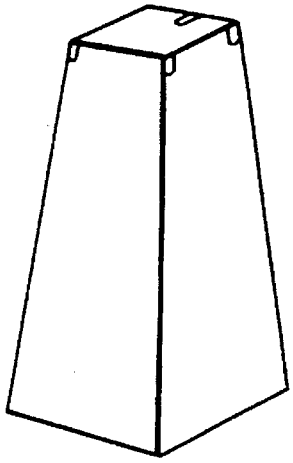
FIG. 3 is a prespective view showing the appearance of the pattern after the tests in the embodiments of this invention were conducted.

One operation is called one shot, and the number of shots indicates the durability of the model. This operation was repeated until the paint film was slightly stripped from part of the pattern's surface, as shown in FIG. 3.

The results of the tests are shown in Tables 17 to 19, in which the number shows the shots, which indicate the number of times the sandmold was produced. When the shots of the pattern to which the powder material of this invention was added increased as compared with that of the pattern to which the paint material was not added, this increased number of shots was evaluated as showing the effect of this invention.

From the above test results, it was found that the effect of the addition of the powder material in a dry paint film of this invention occurs at an added amount of about 5% or more by volume in both the achromatic coatings and the chromatic coatings.

Calcite of a New Mohs' hardness of 3, iron oxide of a New Mohs' hardness of 4, and glass powder of a New Mohs' hardness of 5, were used to conduct the test, as examples of reference, by the same method as mentioned above.

Formulations of the coatings are shown in Tables 3 to 16 and the test results are shown in Tables 17 to 19. In Tables 17 to 19 a dash "–" shows a crack in the paint film which occurred before the test. It was not possible to carry out the sandmold production test on patterns in which the crack had already occurred.

An increase of an added amount of powder material of a New Mohs' hardness of 5 or less in the paint film of the pattern shows results wherein shots do not increase very much, but also, cracks occur, leading to a lower dimensional accuracy. Accordingly, powder material of a New Mohs' hardness of 5 or less cannot give the effect of this invention.

Figure 4:
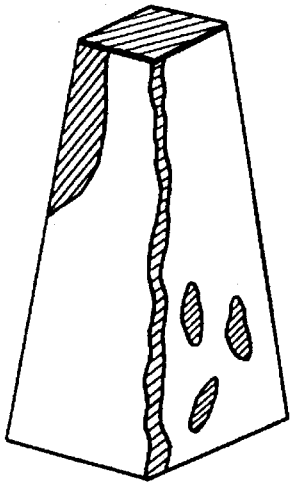
FIG. 4 is a perspective view showing the appearance of the pattern which is composed only of epoxy resin and was being tested by fifty shots.
Figure 5:
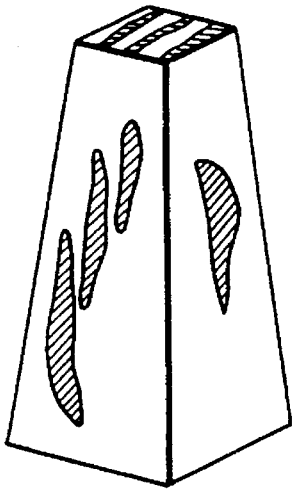
FIG. 5 is a perspective view of the appearance of the pattern which is composed only of aluminium and was being tested by seventy shots.

Test results obtained by conducting tests on the patterns, which patterns are composed of a raw material itself, without any coating, are shown in Tables 4 and 5. FIG. 4 shows the appearance of the pattern made of glass fiber reinforced epoxy resin after a test of fifty shots was conducted. FIG. 5 shows the appearance of the pattern made of aluminium after a test of seventy shots was conducted.

These tests on the pattern itself showed that the pattern substrate itself was damaged, and the dimensional accuracy of a pattern was lowered to such an extent that it was not fit for use, because of the lack of resistance of the pattern substrate against the impact of the casting sand.

TABLE 3

| | Achromatic · Modified · Epoxy-modified Acrylic Coating Formulation | | | | | | | | | |
|---|---|---|---|---|---|---|---|---|---|---|
| | | Volume concentration % | | | | | | | | |
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |
| Acrylic | Dainippon Ink & Chemicals | 64 | → | → | → | → | → | → | → | → |
| Fluoro | Asahi Glass | | | | | | | | | |
| Epoxy | Yuka Shell Epoxy Kabushiki Kaisha | | | | | | | | | |
| Alkyd | Dainippon Ink & Chemicals | | | | | | | | | |
| Vinyl chloride | Union Carbide Corporation | | | | | | | | | |
| Nitrocellulose | Asahi Chemical Industry | | | | | | | | | |
| Maleic | Arakawa Chemical Industries LTD | | | | | | | | | |
| Additive | | | | | | | | | | |
| Plasticizer | Daihachi Chemical Industry Co., LTD | | | | | | | | | |
| Surface active agent | BYK-Chemie Japan K.k. | | | | | | | | | |
| Fluoro-modifier | Nippon Oil & Fats | 1 | → | → | → | → | → | → | → | → |
| Silicone-modifier | Toagosei Chemical Industry | 1 | → | → | → | → | → | → | → | → |
| Moisture remover | Kanegafuchi Chemical Industry | | | | | | | | | |
| Dispersing agent | BYK-Chemie Japan K.k. | 0.5 | → | → | → | → | → | → | → | → |
| Wetting agent | BYK-Chemie Japan K.k. | 0.5 | → | → | → | → | → | → | → | → |
| Consistency modifier | Kyoeisha Chemical Industry Co., LTD | 2 | → | → | → | → | → | → | → | → |
| Solvent | | | | | | | | | | |
| Toluene | | 7 | → | → | → | → | → | → | → | → |
| Xylene | | 8 | → | → | → | → | → | → | → | → |
| Component B | | | | | | | | | | |
| Resin | | | | | | | | | | |
| Epoxy | Dainippon Ink & Chemicals | 16 | → | → | → | → | → | → | → | → |
| Urethane | Takeda Chemical Industry | | | | | | | | | |
| Hardening agent | | | | | | | | | | |
| Aliphatic amine A | Kanegafuchi Chemical Industry | | | | | | | | | |

TABLE 3-continued

| Achromatic · Modified · Epoxy-modified Acrylic Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Aliphatic amine B | Mitsubishi Petrochemical | | | | | | | | | |
| Solvent | | | | | | | | | | |
| Butyl acetate | | | | | | | | | | |
| Xylene | | | | | | | | | | |
| Powder material | | | | | | | | | | |
| Reference | | | | | | | | | | |
| Calcite | 3 (New Mohs' hardness) | 6 | 38 | 49 | 76 | 93 | 113 | 139 | 170 | 210 |
| Iron oxide | 4 (New Mohs' hardness) | 10 | 66 | 85 | 132 | 162 | 198 | 242 | 297 | 368 |
| Glass powder | 5 (New Mohs' hardness) | 5.5 | 33 | 43 | 67 | 82 | 100 | 122 | 150 | 186 |
| Example | | | | | | | | | | |
| Feldspar | 6 (New Mohs' hardness) | 5.5 | 35 | 45 | 69 | 85 | 104 | 127 | 156 | 193 |
| Quartz | 7 (New Mohs' hardness) | 5.5 | 35 | 45 | 70 | 85 | 105 | 127 | 157 | 194 |
| Zirconia | 11 (New Mohs' hardness) | 12 | 75 | 96 | 150 | 184 | 225 | 274 | 385 | 415 |
| Alumina | 12 (New Mohs' hardness) | 8 | 51 | 65 | 101 | 124 | 152 | 186 | 228 | 283 |
| Silicon carbide | 13 (New Mohs' hardness) | 7 | 43 | 55 | 85 | 105 | 128 | 157 | 193 | 238 |
| | | 5 | 25 | 30 | 40 | 45 | 50 | 55 | 60 | 65 |
| | | Volume concentration % | | | | | | | | |

TABLE 4

| Achromatic · Modified · Silicone · Acrylate Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |
| Acrylic | Dainippon Ink & Chemicals | 68 | → | → | → | → | → | → | → | → |
| Fluoro | Asahi Glass | | | | | | | | | |
| Epoxy | Yuka Shell Epoxy Kabushiki Kaisha | | | | | | | | | |
| Alkyd | Dainippon Ink & Chemicals | | | | | | | | | |
| Vinyl chloride | Union Carbide Corporation | | | | | | | | | |
| Nitrocellulose | Asahi Chemical Industry | | | | | | | | | |
| Maleic | Arakawa Chemical Industries LTD | | | | | | | | | |
| Additive | | | | | | | | | | |
| Plasticizer | Daihachi Chemical Industry Co., LTD | | | | | | | | | |
| Surface active agent | BYK-Chemie Japan K.k. | | | | | | | | | |
| Fluoro-modifier | Nippon Oil & Fats | 1 | → | → | → | → | → | → | → | → |
| Silicone-modifier | Toagosei Chemical Industry | 1 | → | → | → | → | → | → | → | → |
| Moisture remover | Kanegafuchi Chemical Industry | 0.5 | → | → | → | → | → | → | → | → |
| Dispersing agent | BYK-Chemie Japan K.k. | 0.5 | → | → | → | → | → | → | → | → |
| Wetting agent | BYK-Chemie Japan K.k. | 0.5 | → | → | → | → | → | → | → | → |
| Consistency modifier | Kyoeisha Chemical Industry Co., LTD | 2.5 | → | → | → | → | → | → | → | → |
| Solvent | | | | | | | | | | |
| Toluene | | 8 | → | → | → | → | → | → | → | → |
| Xylene | | 8 | → | → | → | → | → | → | → | → |
| Component B | | | | | | | | | | |
| Resin | | | | | | | | | | |
| Epoxy | Dainippon Ink & Chemicals | | | | | | | | | |
| Urethane | Takeda Chemical Industry | | | | | | | | | |
| Hardening agent | | | | | | | | | | |
| Aliphatic amine A | Kanegafuchi Chemical Industry | 8 | → | → | → | → | → | → | → | → |
| Aliphatic amine B | Mitsubishi Petrochemical | | | | | | | | | |
| Solvent | | | | | | | | | | |
| Butyl acetate | | | | | | | | | | |
| Xylene | | 2 | → | → | → | → | → | → | → | → |

TABLE 4-continued

| Achromatic · Modified · Silicone · Acrylate Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Powder material | | | | | | | | | | |
| Reference | | | | | | | | | | |
| Calcite | 3 (New Mohs' hardness) | 5 | 32 | 42 | 64 | 80 | 96 | 118 | 145 | 180 |
| Iron oxide | 4 (New Mohs' hardness) | 9 | 56 | 72 | 112 | 140 | 168 | 206 | 253 | 314 |
| Glass powder | 5 (New Mohs' hardness) | 4.5 | 28.5 | 36.5 | 57 | 70 | 86 | 105 | 127 | 158 |
| Example | | | | | | | | | | |
| Feldspar | 6 (New Mohs' hardness) | 4.5 | 29.5 | 38 | 59 | 72.5 | 88 | 108 | 133 | 164 |
| Quartz | 7 (New Mohs' hardness) | 4.5 | 30 | 38 | 59 | 73 | 88 | 108 | 133 | 165 |
| Zirconia | 11 (New Mohs' hardness) | 10 | 64 | 82 | 127 | 156 | 190 | 233 | 286 | 354 |
| Alumina | 12 (New Mohs' hardness) | 7 | 43 | 55 | 86 | 106 | 129 | 156 | 195 | 240 |
| Silicon carbide | 13 (New Mohs' hardness) | 6 | 36 | 47 | 73 | 89 | 109 | 133 | 164 | 202 |
| | | 5 | 25 | 30 | 40 | 45 | 50 | 55 | 60 | 65 |
| | | Volume concentration % | | | | | | | | |

TABLE 5

| Achromatic · Epoxy-modified Acrylic Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |
| Acrylic | Dainippon Ink & Chemicals | 64 | → | → | → | → | → | → | → | → |
| Fluoro | Asahi Glass | | | | | | | | | |
| Epoxy | Yuka Shell Epoxy Kabushiki Kaisha | | | | | | | | | |
| Alkyd | Dainippon Ink & Chemicals | | | | | | | | | |
| Vinyl chloride | Union Carbide Corporation | | | | | | | | | |
| Nitrocellulose | Asahi Chemical Industry | | | | | | | | | |
| Maleic | Arakawa Chemical Industries LTD | | | | | | | | | |
| Additive | | | | | | | | | | |
| Plasticizer | Daihachi Chemical Industry Co., LTD | | | | | | | | | |
| Surface active agent | BYK-Chemie Japan K.k. | 0.5 | → | → | → | → | → | → | → | → |
| Fluoro-modifier | Nippon Oil & Fats | | | | | | | | | |
| Silicone-modifier | Toagosei Chemical Industry | | | | | | | | | |
| Moisture remover | Kanegafuchi Chemical Industry | | | | | | | | | |
| Dispersing agent | BYK-Chemie Japan K.k. | | | | | | | | | |
| Wetting agent | BYK-Chemie Japan K.k. | | | | | | | | | |
| Consistency modifier | Kyoeisha Chemical Industry Co., LTD | 2 | → | → | → | → | → | → | → | → |
| Solvent | | | | | | | | | | |
| Toluene | | 8 | → | → | → | → | → | → | → | → |
| Xylene | | 9.5 | → | → | → | → | → | → | → | → |
| Component B | | | | | | | | | | |
| Resin | | | | | | | | | | |
| Epoxy | Dainippon Ink & Chemicals | 16 | → | → | → | → | → | → | → | → |
| Urethane | Takeda Chemical Industry | | | | | | | | | |
| Hardening agent | | | | | | | | | | |
| Aliphatic amine A | Kanegafuchi Chemical Industry | | | | | | | | | |
| Aliphatic amine B | Mitsubishi Petrochemical | | | | | | | | | |
| Solvent | | | | | | | | | | |
| Butyl acetate | | | | | | | | | | |
| Xylene | | | | | | | | | | |
| Powder material | | | | | | | | | | |
| Reference | | | | | | | | | | |
| Calcite | 3 (New Mohs' hardness) | 6 | 38 | 49 | 76 | 93 | 113 | 139 | 170 | 210 |

TABLE 5-continued

| Achromatic · Epoxy-modified Acrylic Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Iron oxide | 4 (New Mohs' hardness) | 10 | 66 | 85 | 132 | 162 | 198 | 242 | 297 | 368 |
| Glass powder | 5 (New Mohs' hardness) | 5.5 | 33 | 43 | 67 | 82 | 100 | 122 | 150 | 186 |
| Example | | | | | | | | | | |
| Feldspar | 6 (New Mohs' hardness) | 5.5 | 35 | 45 | 69 | 85 | 104 | 127 | 156 | 193 |
| Quartz | 7 (New Mohs' hardness) | 5.5 | 35 | 45 | 70 | 85 | 105 | 127 | 157 | 194 |
| Zirconia | 11 (New Mohs' hardness) | 12 | 75 | 96 | 150 | 184 | 225 | 274 | 335 | 415 |
| Alumina | 12 (New Mohs' hardness) | 8 | 51 | 65 | 101 | 124 | 152 | 186 | 228 | 283 |
| Silicon carbide | 13 (New Mohs' hardness) | 7 | 43 | 55 | 85 | 105 | 128 | 157 | 193 | 238 |
| | | 5 | 25 | 30 | 40 | 45 | 50 | 55 | 60 | 65 |
| | | Volume concentration % | | | | | | | | |

TABLE 6

| Achromatic · Silicone · Acrylate Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |
| Acrylic | Dainippon Ink & Chemicals | 68 | → | → | → | → | → | → | → | → |
| Fluoro | Asahi Glass | | | | | | | | | |
| Epoxy | Yuka Shell Epoxy Kabushiki Kaisha | | | | | | | | | |
| Alkyd | Dainippon Ink & Chemicals | | | | | | | | | |
| Vinyl chloride | Union Carbide Corporation | | | | | | | | | |
| Nitrocellulose | Asahi Chemical Industry | | | | | | | | | |
| Maleic | Arakawa Chemical Industries LTD | | | | | | | | | |
| Additive | | | | | | | | | | |
| Plasticizer | Daihachi Chemical Industry Co., LTD | | | | | | | | | |
| Surface active agent | BYK-Chemie Japan K.K. | 0.5 | → | → | → | → | → | → | → | → |
| Fluoro-modifier | Nippon Oil & Fats | | | | | | | | | |
| Silicone-modifier | Toagosei Chemical Industry | | | | | | | | | |
| Moisture remover | Kanegafuchi Chemical Industry | | | | | | | | | |
| Dispersing agent | BYK-Chemie Japan K.K. | 0.5 | → | → | → | → | → | → | → | → |
| Wetting agent | BYK-Chemie Japan K.K. | | | | | | | | | |
| Consistency modifier | Kyoeisha Chemical Industry Co., LTD | 2 | → | → | → | → | → | → | → | → |
| Solvent | | | | | | | | | | |
| Toluene | | 10 | → | → | → | → | → | → | → | → |
| Xylene | | 9 | → | → | → | → | → | → | → | → |
| Component B | | | | | | | | | | |
| Resin | | | | | | | | | | |
| Epoxy | Dainippon Ink & Chemicals | | | | | | | | | |
| Urethane | Takeda Chemical Industry | | | | | | | | | |
| Hardening agent | | | | | | | | | | |
| Aliphatic amine A | Kanegafuchi Chemical Industry | 8 | → | → | → | → | → | → | → | → |
| Aliphatic amine B | Mitsubishi Petrochemical | | | | | | | | | |
| Solvent | | | | | | | | | | |
| Butyl acetate | | 2 | → | → | → | → | → | → | → | → |
| Xylene | | | | | | | | | | |
| Powder material | | | | | | | | | | |
| Reference | | | | | | | | | | |
| Calcite | 3 (New Mohs' hardness) | 5 | 32 | 42 | 64 | 80 | 96 | 118 | 145 | 180 |
| Iron oxide | 4 (New Mohs' hardness) | 9 | 56 | 72 | 112 | 140 | 168 | 206 | 253 | 314 |
| Glass powder | 5 (New Mohs' hardness) | 5 | 29 | 37 | 57 | 70 | 86 | 105 | 127 | 158 |
| Example | | | | | | | | | | |
| Feldspar | 6 (New Mohs' hardness) | 5 | 30 | 38 | 59 | 73 | 89 | 108 | 133 | 164 |

TABLE 6-continued

Achromatic · Silicone · Acrylate Coating Formulation

| | | Volume concentration % | | | | | | | | |
|---|---|---|---|---|---|---|---|---|---|---|
| | | 5 | 25 | 30 | 40 | 45 | 50 | 55 | 60 | 65 |
| Quartz | 7 (New Mohs' hardness) | 5 | 30 | 39 | 60 | 73 | 89 | 108 | 133 | 165 |
| Zirconia | 11 (New Mohs' hardness) | 10 | 64 | 83 | 127 | 157 | 190 | 233 | 286 | 354 |
| Alumina | 12 (New Mohs' hardness) | 7 | 43 | 56 | 87 | 107 | 130 | 156 | 196 | 240 |
| Silicon carbide | 13 (New Mohs' hardness) | 6 | 37 | 47 | 73 | 89 | 109 | 133 | 164 | 202 |
| | | 5 | 25 | 30 | 40 | 45 | 50 | 55 | 60 | 65 |
| | | Volume concentration % | | | | | | | | |

TABLE 7

Achromatic · Fluoro Coating Formulation

| | | Volume concentration % | | | | | | | | |
|---|---|---|---|---|---|---|---|---|---|---|
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |
| Acrylic | Dainippon Ink & Chemicals | | | | | | | | | |
| Fluoro | Asahi Glass | 50 | → | → | → | → | → | → | → | → |
| Epoxy | Yuka Shell Epoxy Kabushiki Kaisha | | | | | | | | | |
| Alkyd | Dainippon Ink & Chemicals | | | | | | | | | |
| Vinyl chloride | Union Carbide Corporation | | | | | | | | | |
| Nitrocellulose | Asahi Chemical Industry | | | | | | | | | |
| Maleic | Arakawa Chemical Industries LTD | | | | | | | | | |
| Additive | | | | | | | | | | |
| Plasticizer | Daihachi Chemical Industry Co., LTD | | | | | | | | | |
| Surface active agent | BYK-Chemie Japan K.K. | 0.5 | → | → | → | → | → | → | → | → |
| Fluoro-modifier | Nippon Oil & Fats | | | | | | | | | |
| Silicone-modifier | Toagosei Chemical Industry | | | | | | | | | |
| Moisture remover | Kanegafuchi Chemical Industry | | | | | | | | | |
| Dispersing agent | BYK-Chemie Japan K.K. | | | | | | | | | |
| Wetting agent | BYK-Chemie Japan K.K. | | | | | | | | | |
| Consistency modifier | Kyoeisha Chemical Industry Co., LTD | | | | | | | | | |
| Solvent | | | | | | | | | | |
| Toluene | | | | | | | | | | |
| Xylene | | 22 | → | → | → | → | → | → | → | → |
| Component B | | | | | | | | | | |
| Resin | | | | | | | | | | |
| Epoxy | Dainippon Ink & Chemicals | | | | | | | | | |
| Urethane | Takeda Chemical Industry | 5 | → | → | → | → | → | → | → | → |
| Hardening agent | | | | | | | | | | |
| Aliphatic amine A | Kanegafuchi Chemical Industry | | | | | | | | | |
| Aliphatic amine B | Mitsubishi Petrochemical | | | | | | | | | |
| Solvent | | | | | | | | | | |
| Butyl acetate | | 20 | → | → | → | → | → | → | → | → |
| Xylene | | | | | | | | | | |
| Powder material | | | | | | | | | | |
| Reference | | | | | | | | | | |
| Calcite | 3 (New Mohs' hardness) | | | | | | | | | |
| Iron oxide | 4 (New Mohs' hardness) | | | | | | | | | |
| Glass powder | 5 (New Mohs' hardness) | | | | | | | | | |
| Example | | | | | | | | | | |
| Feldspar | 6 (New Mohs' hardness) | | | | | | | | | |
| Quartz | 7 (New Mohs' hardness) | | | | | | | | | |
| Zirconia | 11 (New Mohs' hardness) | | | | | | | | | |
| Alumina | 12 (New Mohs' hardness) | 5.5 | 34.5 | 44.5 | 69 | 85 | 104 | 127 | 156 | 193 |

TABLE 7-continued

| | | Achromatic · Fluoro Coating Formulation | | | | | | | | |
|---|---|---|---|---|---|---|---|---|---|---|
| | | Volume concentration % | | | | | | | | |
| | | 5 | 25 | 30 | 40 | 45 | 50 | 55 | 60 | 65 |
| Silicon carbide | 13 (New Mohs' hardness) | | | | | | | | | |
| | | 5 | 25 | 30 | 40 | 45 | 50 | 55 | 60 | 65 |
| | | Volume concentration % | | | | | | | | |

TABLE 8

| | | Achromatic · Urethane Coating Formulation | | | | | | | | |
|---|---|---|---|---|---|---|---|---|---|---|
| | | Volume concentration % | | | | | | | | |
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |
| Acrylic | Dainippon Ink & Chemicals | | | | | | | | | |
| Fluoro | Asahi Glass | | | | | | | | | |
| Epoxy | Yuka Shell Epoxy Kabushiki Kaisha | | | | | | | | | |
| Alkyd | Dainippon Ink & Chemicals | 40 | → | → | → | → | → | → | → | → |
| Vinyl chloride | Union Carbide Corporation | 3 | → | → | → | → | → | → | → | → |
| Nitrocellulose | Asahi Chemical Industry | 3 | → | → | → | → | → | → | → | → |
| Maleic | Arakawa Chemical Industries LTD | | | | | | | | | |
| Additive | | | | | | | | | | |
| Plasticizer | Daihachi Chemical Industry Co., LTD | | | | | | | | | |
| Surface active agent | BYK-Chemie Japan K.K. | | | | | | | | | |
| Fluoro-modifier | Nippon Oil & Fats | | | | | | | | | |
| Silicone-modifier | Toagosei Chemical Industry | | | | | | | | | |
| Moisture remover | Kanegafuchi Chemical Industry | 0.5 | → | → | → | → | → | → | → | → |
| Dispersing agent | BYK-Chemie Japan K.K. | 0.5 | → | → | → | → | → | → | → | → |
| Wetting agent | BYK-Chemie Japan K.K. | | | | | | | | | |
| Consistency modifier | Kyoeisha Chemical Industry Co., LTD | 2 | → | → | → | → | → | → | → | → |
| Solvent | | | | | | | | | | |
| Toluene | | 10 | → | → | → | → | → | → | → | → |
| Butyl acetate | | 6 | → | → | → | → | → | → | → | → |
| Ethyl acetate | | 15 | → | → | → | → | → | → | → | → |
| Component B | | | | | | | | | | |
| Resin | | | | | | | | | | |
| Urethane | Takeda Chemical Industry | 13 | → | → | → | → | → | → | → | → |
| Hardening agent | | | | | | | | | | |
| Aliphatic amine A | Kanegafuchi Chemical Industry | | | | | | | | | |
| Aliphatic amine B | Mitsubishi Petrochemical | | | | | | | | | |
| Solvent | | | | | | | | | | |
| Butyl acetate | | 7 | → | → | → | → | → | → | → | → |
| Xylene | | | | | | | | | | |
| Powder material | | | | | | | | | | |
| Reference | | | | | | | | | | |
| Calcite | 3 (New Mohs' hardness) | | | | | | | | | |
| Iron oxide | 4 (New Mohs' hardness) | | | | | | | | | |
| Glass powder | 5 (New Mohs' hardness) | | | | | | | | | |
| Example | | | | | | | | | | |
| Feldspar | 6 (New Mohs' hardness) | | | | | | | | | |
| Quartz | 7 (New Mohs' hardness) | | | | | | | | | |
| Zirconia | 11 (New Mohs' hardness) | | | | | | | | | |
| Alumina | 12 (New Mohs' hardness) | 4 | 26 | 33.5 | 52.5 | 64 | 78.5 | 96 | 118 | 146 |
| Silicon carbide | 13 (New Mohs' hardness) | | | | | | | | | |
| | | 5 | 25 | 30 | 40 | 45 | 50 | 55 | 60 | 65 |
| | | Volume concentration % | | | | | | | | |

TABLE 9

Achromatic · Lacquer · Alkyd Coating Formulation

| | | Volume concentration % | | | | | | | | |
|---|---|---|---|---|---|---|---|---|---|---|
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |
| Acrylic | Dainippon Ink & Chemicals | | | | | | | | | |
| Fluoro | Asahi Glass | | | | | | | | | |
| Epoxy | Yuka Shell Epoxy Kabushiki Kaisha | | | | | | | | | |
| Alkyd | Dainippon Ink & Chemicals | 17 | → | → | → | → | → | → | → | → |
| Vinyl chloride | Union Carbide Corporation | | | | | | | | | |
| Nitrocellulose | Asahi Chemical Industry | 15 | → | → | → | → | → | → | → | → |
| Maleic | Arakawa Chemical Industries LTD | 8 | → | → | → | → | → | → | → | → |
| Additive | | | | | | | | | | |
| Plasticizer | Daihachi Chemical Industry Co., LTD | 4 | → | → | → | → | → | → | → | → |
| Surface active agent | BYK-Chemie Japan K.K. | | | | | | | | | |
| Fluoro-modifier | Nippon Oil & Fats | | | | | | | | | |
| Silicone-modifier | Toagosei Chemical Industry | | | | | | | | | |
| Moisture remover | Kanegafuchi Chemical Industry | | | | | | | | | |
| Dispersing agent | BYK-Chemie Japan K.K. | | | | | | | | | |
| Wetting agent | BYK-Chemie Japan K.K. | | | | | | | | | |
| Consistency modifier | Kyoeisha Chemical Industry Co., LTD | 2 | → | → | → | → | → | → | → | → |
| Solvent | | | | | | | | | | |
| Toluene | | 24 | → | → | → | → | → | → | → | → |
| Butanol | | 10 | → | → | → | → | → | → | → | → |
| Component B | | | | | | | | | | |
| Resin | | | | | | | | | | |
| Epoxy | Dainippon Ink & Chemicals | | | | | | | | | |
| Urethane | Takeda Chemical Industry | | | | | | | | | |
| Hardening agent | | | | | | | | | | |
| Aliphatic amine A | Kanegafuchi Chemical Industry | | | | | | | | | |
| Aliphatic amine B | Mitsubishi Petrochemical | | | | | | | | | |
| Solvent | | | | | | | | | | |
| Butyl acetate | | 13 | → | → | → | → | → | → | → | → |
| Ethyl acetate | | 7 | → | → | → | → | → | → | → | → |
| Powder material | | | | | | | | | | |
| Reference | | | | | | | | | | |
| Calcite | 3 (New Mohs' hardness) | | | | | | | | | |
| Iron oxide | 4 (New Mohs' hardness) | | | | | | | | | |
| Glass powder | 5 (New Mohs' hardness) | | | | | | | | | |
| Example | | | | | | | | | | |
| Feldspar | 6 (New Mohs' hardness) | | | | | | | | | |
| Quartz | 7 (New Mohs' hardness) | | | | | | | | | |
| Zirconia | 11 (New Mohs' hardness) | | | | | | | | | |
| Alumina | 12 (New Mohs' hardness) | 2.5 | 17 | 21.5 | 33.5 | 41 | 50 | 61.5 | 75 | 93 |
| Silicon carbide | 13 (New Mohs' hardness) | | | | | | | | | |
| | | 5 | 25 | 30 | 40 | 45 | 50 | 55 | 60 | 65 |
| | | Volume concentration % | | | | | | | | |

TABLE 10

Chromatic · Modified · Epoxy-modified Acrylic Coating Formulation

| | | Volume concentration % | | | | | | | | |
|---|---|---|---|---|---|---|---|---|---|---|
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |

TABLE 10-continued

Chromatic · Modified · Epoxy-modified Acrylic Coating Formulation

| | | Volume concentration % | | | | | | | | |
|---|---|---|---|---|---|---|---|---|---|---|
| | | 5 | 25 | 30 | 40 | 45 | 50 | 55 | 60 | 65 |
| Acrylic A | Dainippon Ink & Chemicals | 60 | → | → | → | → | → | → | → | → |
| Acrylic B | Dainippon Ink & Chemicals | 4 | → | → | → | → | → | → | → | → |
| Fluoro | Asahi Glass | | | | | | | | | |
| Epoxy | Yuka Shell Epoxy Kabushiki Kaisha | | | | | | | | | |
| Alkyd | Dainippon Ink & Chemicals | | | | | | | | | |
| Vinyl chloride | Union Carbide Corporation | | | | | | | | | |
| Nitrocellulose | Asahi Chemical Industry | | | | | | | | | |
| Maleic | Arakawa Chemical Industries LTD | | | | | | | | | |
| Additive | | | | | | | | | | |
| Plasticizer | Daihachi Chemical Industry Co., LTD | | | | | | | | | |
| Surface active agent | BYK-Chemie Japan K.K. | | | | | | | | | |
| Fluoro-modifier | Nippon Oil & Fats | 1 | → | → | → | → | → | → | → | → |
| Silicone-modifier | Toagosei Chemical Industry | 1 | → | → | → | → | → | → | → | → |
| Moisture remover | Kanegafuchi Chemical Industry | | | | | | | | | |
| Dispersing agent | BYK-Chemie Japan K.K. | 0.5 | → | → | → | → | → | → | → | → |
| Wetting agent | BYK-Chemie Japan K.K. | 0.5 | → | → | → | → | → | → | → | → |
| Consistency modifier | Kyoeisha Chemical Industry Co., LTD | 2 | → | → | → | → | → | → | → | → |
| Solvent | | | | | | | | | | |
| Toluene | | 7 | → | → | → | → | → | → | → | → |
| Xylene | | 8 | → | → | → | → | → | → | → | → |
| Component B | | | | | | | | | | |
| Resin | | | | | | | | | | |
| Epoxy | Dainippon Ink & Chemicals | 15 | → | → | → | → | → | → | → | → |
| Urethane | Takeda Chemical Industry | 1 | → | → | → | → | → | → | → | → |
| Hardening agent | | | | | | | | | | |
| Aliphatic amine A | Kanegafuchi Chemical Industry | | | | | | | | | |
| Aliphatic amine B | Mitsubishi Petrochemical | | | | | | | | | |
| Solvent | | | | | | | | | | |
| Butyl acetate | | | | | | | | | | |
| Xylene | | | | | | | | | | |
| Colorant | | | | | | | | | | |
| Panastain | Fuji Toryo Co., Ltd. | 2 | → | → | → | → | → | → | → | → |
| Powder material | | | | | | | | | | |
| Reference | | | | | | | | | | |
| Calcite | 3 (New Mohs' hardness) | 5 | 32 | 41.5 | 64 | 79 | 96 | 118 | 144 | 179 |
| Iron oxide | 4 (New Mohs' hardness) | 9 | 56 | 72 | 112 | 138 | 168 | 206 | 253 | 313 |
| Glass powder | 5 (New Mohs' hardness) | 5.5 | 33.5 | 43 | 66.5 | 82 | 100 | 122 | 150 | 186 |
| Example | | | | | | | | | | |
| Feldspar | 6 (New Mohs' hardness) | 5.5 | 35 | 44.5 | 67 | 85 | 104 | 127 | 156 | 193 |
| Quartz | 7 (New Mohs' hardness) | 5.5 | 35 | 45 | 67 | 85 | 105 | 127 | 157 | 194 |
| Zirconia | 11 (New Mohs' hardness) | 12 | 75 | 96 | 149 | 184 | 224 | 274 | 335 | 415 |
| Alumina | 12 (New Mohs' hardness) | 8 | 50.5 | 65 | 101 | 124 | 152 | 186 | 228 | 283 |
| Silicon carbide | 13 (New Mohs' hardness) | 7 | 42.5 | 55 | 85 | 105 | 128 | 157 | 193 | 238 |
| | | 5 | 25 | 30 | 40 | 45 | 50 | 55 | 60 | 65 |
| | | Volume concentration % | | | | | | | | |

TABLE 11

Chromatic · Modified · Silicone Acrylate Coating Formulation

| | | Volume concentration % | | | | | | | | |
|---|---|---|---|---|---|---|---|---|---|---|
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |
| Acrylic B | Dainippon Ink & Chemicals | 64 | → | → | → | → | → | → | → | → |

TABLE 11-continued

Chromatic · Modified · Silicone Acrylate Coating Formulation

| | | Volume concentration % | | | | | | | | |
|---|---|---|---|---|---|---|---|---|---|---|
| | | 5 | 25 | 30 | 40 | 45 | 50 | 55 | 60 | 65 |
| Fluoro | Asahi Glass | 4 | → | → | → | → | → | → | → | → |
| Epoxy | Yuka Shell Epoxy Kabushiki Kaisha | | | | | | | | | |
| Alkyd | Dainippon Ink & Chemicals | | | | | | | | | |
| Vinyl chloride | Union Carbide Corporation | | | | | | | | | |
| Nitrocellulose | Asahi Chemical Industry | | | | | | | | | |
| Maleic | Arakawa Chemical Industries LTD | | | | | | | | | |
| Additive | | | | | | | | | | |
| Plasticizer | Daihachi Chemical Industry Co., LTD | | | | | | | | | |
| Surface active agent | BYK-Chemie Japan K.K. | | | | | | | | | |
| Fluoro-modifier | Nippon Oil & Fats | 1 | → | → | → | → | → | → | → | → |
| Silicone-modifier | Toagosei Chemical Industry | 1 | → | → | → | → | → | → | → | → |
| Moisture remover | Kanegafuchi Chemical Industry | 0.5 | → | → | → | → | → | → | → | → |
| Dispersing agent | BYK-Chemie Japan K.K. | 0.5 | → | → | → | → | → | → | → | → |
| Wetting agent | BYK-Chemie Japan K.K. | 0.5 | → | → | → | → | → | → | → | → |
| Consistency modifier | Kyoeisha Chemical Industry Co., LTD | 2.5 | → | → | → | → | → | → | → | → |
| Solvent | | | | | | | | | | |
| Toluene | | 8 | → | → | → | → | → | → | → | → |
| Xylene | | 8 | → | → | → | → | → | → | → | → |
| Component B | | | | | | | | | | |
| Resin | | | | | | | | | | |
| Epoxy | Dainippon Ink & Chemicals | | | | | | | | | |
| Urethane | Takeda Chemical Industry | 1 | → | → | → | → | → | → | → | → |
| Hardening agent | | | | | | | | | | |
| Aliphatic amine A | Kanegafuchi Chemical Industry | 8 | → | → | → | → | → | → | → | → |
| Aliphatic amine B | Mitsubishi Petrochemical | | | | | | | | | |
| Solvent | | | | | | | | | | |
| Butyl acetate | | | | | | | | | | |
| Xylene | | 2 | → | → | → | → | → | → | → | → |
| Colorant | | | | | | | | | | |
| Panastain | Fuji Toryo Co., Ltd. | 2 | → | → | → | → | → | → | → | → |
| Powder material | | | | | | | | | | |
| Reference | | | | | | | | | | |
| Calcite | 3 (New Mohs' hardness) | 5 | 32 | 42 | 64 | 80 | 96 | 118 | 145 | 180 |
| Iron oxide | 4 (New Mohs' hardness) | 9 | 56 | 72 | 112 | 140 | 168 | 206 | 253 | 314 |
| Glass powder | 5 (New Mohs' hardness) | 4.5 | 28.5 | 36.5 | 57 | 70 | 86 | 105 | 127 | 158 |
| Example | | | | | | | | | | |
| Feldspar | 6 (New Mohs' hardness) | 4.5 | 29.5 | 38 | 59 | 72.5 | 88 | 108 | 135 | 167 |
| Quartz | 7 (New Mohs' hardness) | 4.5 | 30 | 38 | 59 | 73 | 88 | 108 | 135 | 167 |
| Zirconia | 11 (New Mohs' hardness) | 10 | 64 | 82 | 127 | 156 | 190 | 233 | 289 | 358 |
| Alumina | 12 (New Mohs' hardness) | 7 | 43 | 55 | 86 | 106 | 129 | 156 | 196 | 240 |
| Silicon carbide | 13 (New Mohs' hardness) | 6 | 36 | 47 | 73 | 89 | 109 | 133 | 166 | 205 |
| | | 5 | 25 | 30 | 40 | 45 | 50 | 55 | 60 | 65 |
| | | Volume concentration % | | | | | | | | |

TABLE 12

Chromatic · Epoxy · Acrylate Coating Formulation

| | | Volume concentration % | | | | | | | | |
|---|---|---|---|---|---|---|---|---|---|---|
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |
| Acrylic | Dainippon Ink & Chemicals | 64 | → | → | → | → | → | → | → | → |
| Fluoro | Asahi Glass | | | | | | | | | |
| Epoxy | Yuka Shell Epoxy Kabushiki Kaisha | | | | | | | | | |

TABLE 12-continued

| Chromatic · Epoxy · Acrylate Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Alkyd | Dainippon Ink & Chemicals | | | | | | | | | |
| Vinyl chloride | Union Carbide Corporation | | | | | | | | | |
| Nitrocellulose | Asahi Chemical Industry | | | | | | | | | |
| Maleic | Arakawa Chemical Industries LTD | | | | | | | | | |
| Additive | | | | | | | | | | |
| Plasticizer | Daihachi Chemical Industry Co., LTD | | | | | | | | | |
| Surface active agent | BYK-Chemie Japan K.K. | 0.5 | → | → | → | → | → | → | → | → |
| Fluoro-modifier | Nippon Oil & Fats | | | | | | | | | |
| Silicone-modifier | Toagosei Chemical Industry | | | | | | | | | |
| Moisture remover | Kanegafuchi Chemical Industry | | | | | | | | | |
| Dispersing agent | BYK-Chemie Japan K.K. | | | | | | | | | |
| Wetting agent | BYK-Chemie Japan K.K. | | | | | | | | | |
| Consistency modifier | Kyoeisha Chemical Industry Co., LTD | 2 | → | → | → | → | → | → | → | → |
| Solvent | | | | | | | | | | |
| Toluene | | 8 | → | → | → | → | → | → | → | → |
| Xylene | | 9.5 | → | → | → | → | → | → | → | → |
| Component B | | | | | | | | | | |
| Resin | | | | | | | | | | |
| Epoxy | Dainippon Ink & Chemicals | 16 | → | → | → | → | → | → | → | → |
| Urethane | Takeda Chemical Industry | | | | | | | | | |
| Hardening agent | | | | | | | | | | |
| Aliphatic amine A | Kanegafuchi Chemical Industry | | | | | | | | | |
| Aliphatic amine B | Mitsubishi Petrochemical | | | | | | | | | |
| Solvent | | | | | | | | | | |
| Butyl acetate | | | | | | | | | | |
| Xylene | | | | | | | | | | |
| Colorant | | | | | | | | | | |
| Panastain | Fuji Toryo Co., Ltd. | 5 | → | → | → | → | → | → | → | → |
| Powder material | | | | | | | | | | |
| Reference | | | | | | | | | | |
| Calcite | 3 (New Mohs' hardness) | 5 | 32 | 41.5 | 64 | 79 | 96 | 118 | 144 | 179 |
| Iron oxide | 4 (New Mohs' hardness) | 9 | 56 | 72 | 112 | 138 | 168 | 206 | 253 | 313 |
| Glass powder | 5 (New Mohs' hardness) | 5.5 | 33.5 | 43 | 66.5 | 82 | 100 | 122 | 150 | 186 |
| Example | | | | | | | | | | |
| Feldspar | 6 (New Mohs' hardness) | 5.5 | 35 | 44.5 | 67 | 85 | 104 | 127 | 156 | 193 |
| Quartz | 7 (New Mohs' hardness) | 5.5 | 35 | 45 | 67 | 85 | 105 | 127 | 157 | 194 |
| Zirconia | 11 (New Mohs' hardness) | 12 | 75 | 96 | 149 | 184 | 224 | 274 | 335 | 415 |
| Alumina | 12 (New Mohs' hardness) | 8 | 50.5 | 65 | 101 | 124 | 152 | 186 | 239 | 296 |
| Silicon carbide | 13 (New Mohs' hardness) | 7 | 42.5 | 55 | 85 | 105 | 128 | 157 | 193 | 238 |
| | | 5 | 25 | 30 | 40 | 45 | 50 | 55 | 60 | 65 |
| | | Volume concentration % | | | | | | | | |

TABLE 13

| Chromatic · Silicone Acrylate Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | 68 | → | → | → | → | → | → | → | → |
| Acrylic B | Dainippon Ink & Chemicals | 4 | → | → | → | → | → | → | → | → |
| Fluoro | Asahi Glass | | | | | | | | | |
| Epoxy | Yuka Shell Epoxy Kabushiki Kaisha | | | | | | | | | |
| Alkyd | Dainippon Ink & Chemicals | | | | | | | | | |
| Vinyl chloride | Union Carbide Corporation | | | | | | | | | |

TABLE 13-continued

Chromatic · Silicone Acrylate Coating Formulation

| | | Volume concentration % | | | | | | | | |
|---|---|---|---|---|---|---|---|---|---|---|
| | | 5 | 25 | 30 | 40 | 45 | 50 | 55 | 60 | 65 |
| Nitrocellulose | Asahi Chemical Industry | | | | | | | | | |
| Maleic | Arakawa Chemical Industries LTD | | | | | | | | | |
| Additive | | | | | | | | | | |
| Plasticizer | Daihachi Chemical Industry Co., LTD | | | | | | | | | |
| Surface active | BYK-Chemie Japan K.K. | 0.5 | → | → | → | → | → | → | → | → |
| Fluoro-modifier | Nippon Oil & Fats | | | | | | | | | |
| Silicone-modifier | Toagosei Chemical Industry | | | | | | | | | |
| Moisture remover | Kanegafuchi Chemical Industry | | | | | | | | | |
| Dispersing agent | BYK-Chemie Japan K.K. | 0.5 | → | → | → | → | → | → | → | → |
| Wetting agent | BYK-Chemie Japan K.K. | | | | | | | | | |
| Consistency modifier | Kyoeisha Chemical Industry Co., LTD | 2 | → | → | → | → | → | → | → | → |
| Solvent | | | | | | | | | | |
| Toluene | | 10 | → | → | → | → | → | → | → | → |
| Xylene | | 9 | → | → | → | → | → | → | → | → |
| Component B | | | | | | | | | | |
| Resin | | | | | | | | | | |
| Epoxy | Dainippon Ink & Chemicals | | | | | | | | | |
| Urethane | Takeda Chemical Industry | 1 | → | → | → | → | → | → | → | → |
| Hardening agent | | | | | | | | | | |
| Aliphatic amine A | Kanegafuchi Chemical Industry | 8 | → | → | → | → | → | → | → | → |
| Aliphatic amine B | Mitsubishi Petrochemical | | | | | | | | | |
| Solvent | | | | | | | | | | |
| Butyl acetate | | | | | | | | | | |
| Xylene | | 2 | → | → | → | → | → | → | → | → |
| Colorant | | | | | | | | | | |
| Panastain | Fuji Toryo Co., Ltd. | 2 | → | → | → | → | → | → | → | → |
| Powder material | | | | | | | | | | |
| Reference | | | | | | | | | | |
| Calcite | 3 (New Mohs' hardness) | 5 | 32 | 42 | 64 | 80 | 96 | 118 | 145 | 179 |
| Iron oxide | 4 (New Mohs' hardness) | 9 | 56 | 72 | 112 | 140 | 168 | 206 | 253 | 314 |
| Glass powder | 5 (New Mohs' hardness) | 4.5 | 28.5 | 36.5 | 57 | 70 | 86 | 105 | 127 | 158 |
| Example | | | | | | | | | | |
| Feldspar | 6 (New Mohs' hardness) | 4.5 | 29.5 | 38 | 59 | 72.5 | 88 | 108 | 135 | 167 |
| Quartz | 7 (New Mohs' hardness) | 4.5 | 30 | 38 | 59 | 73 | 88 | 108 | 135 | 167 |
| Zirconia | 11 (New Mohs' hardness) | 10 | 64 | 82 | 127 | 156 | 190 | 233 | 289 | 358 |
| Alumina | 12 (New Mohs' hardness) | 7 | 43 | 55 | 86 | 106 | 129 | 156 | 196 | 240 |
| Silicon carbide | 13 (New Mohs' hardness) | 6 | 36 | 47 | 73 | 89 | 109 | 133 | 166 | 205 |
| | | 5 | 25 | 30 | 40 | 45 | 50 | 55 | 60 | 65 |
| | | Volume concentration % | | | | | | | | |

TABLE 14

Chromatic · Fluororesin Coating Formulation

| | | Volume concentration % | | | | | | | | |
|---|---|---|---|---|---|---|---|---|---|---|
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |
| Acrylic B | Dainippon Ink & Chemicals | 4 | → | → | → | → | → | → | → | → |
| Fluoro | Asahi Glass | 46 | → | → | → | → | → | → | → | → |
| Epoxy | Yuka Shell Epoxy Kabushiki Kaisha | | | | | | | | | |
| Alkyd | Dainippon Ink & Chemicals | | | | | | | | | |
| Vinyl chloride | Union Carbide Corporation | | | | | | | | | |
| Nitrocellulose | Asahi Chemical Industry | | | | | | | | | |
| Maleic | Arakawa Chemical Industries LTD | | | | | | | | | |

TABLE 14-continued

| Chromatic · Fluororesin Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Additive | | | | | | | | | | |
| Plasticizer | Daihachi Chemical Industry Co., LTD | | | | | | | | | |
| Surface active agent | BYK-Chemie Japan K.K. | 0.5 | → | → | → | → | → | → | → | → |
| Fluoro-modifier | Nippon Oil & Fats | | | | | | | | | |
| Silicone-modifier | Toagosei Chemical Industry | | | | | | | | | |
| Moisture remover | Kanegafuchi Chemical Industry | | | | | | | | | |
| Dispersing agent | BYK-Chemie Japan K.K. | 0.5 | → | → | → | → | → | → | → | → |
| Wetting agent | BYK-Chemie Japan K.K. | | | | | | | | | |
| Consistency modifier | Kyoeisha Chemical Industry Co., LTD | 2 | → | → | → | → | → | → | → | → |
| Solvent | | | | | | | | | | |
| Toluene | | 22 | → | → | → | → | → | → | → | → |
| Xylene | | | | | | | | | | |
| Component B | | | | | | | | | | |
| Resin | | | | | | | | | | |
| Epoxy | Dainippon Ink & Chemicals | | | | | | | | | |
| Urethane | Takeda Chemical Industry | 5 | → | → | → | → | → | → | → | → |
| Hardening agent | | | | | | | | | | |
| Aliphatic amine A | Kanegafuchi Chemical Industry | | | | | | | | | |
| Aliphatic amine B | Mitsubishi Petrochemical | | | | | | | | | |
| Solvent | | | | | | | | | | |
| Butyl acetate | | 20 | → | → | → | → | → | → | → | → |
| Xylene | | | | | | | | | | |
| Colorant | | | | | | | | | | |
| Panastain | Fuji Toryo Co., Ltd. | 2 | → | → | → | → | → | → | → | → |
| Powder material | | | | | | | | | | |
| Reference | | | | | | | | | | |
| Calcite | 3 (New Mohs' hardness) | | | | | | | | | |
| Iron oxide | 4 (New Mohs' hardness) | | | | | | | | | |
| Glass powder | 5 (New Mohs' hardness) | | | | | | | | | |
| Example | | | | | | | | | | |
| Feldspar | 6 (New Mohs' hardness) | | | | | | | | | |
| Quartz | 7 (New Mohs' hardness) | | | | | | | | | |
| Zirconia | 11 (New Mohs' hardness) | | | | | | | | | |
| Alumina | 12 (New Mohs' hardness) | 5.5 | 34.5 | 44.5 | 69 | 85 | 104 | 127 | 157 | 194 |
| Silicon carbide | 13 (New Mohs' hardness) | | | | | | | | | |
| | | 5 | 25 | 30 | 40 | 45 | 50 | 55 | 60 | 65 |
| | | Volume concentration % | | | | | | | | |

TABLE 15

| Chromatic · Urethane Resin Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |
| Acrylic B | Dainippon Ink & Chemicals | 4 | → | → | → | → | → | → | → | → |
| Fluoro | Asahi Glass | | | | | | | | | |
| Epoxy | Yuka Shell Epoxy Kabushiki Kaisha | | | | | | | | | |
| Alkyd | Dainippon Ink & Chemicals | 36 | → | → | → | → | → | → | → | → |
| Vinyl chloride | Union Carbide Corporation | 3 | → | → | → | → | → | → | → | → |
| Nitrocellulose | Asahi Chemical Industry | 3 | → | → | → | → | → | → | → | → |
| Maleic | Arakawa Chemical Industries LTD | | | | | | | | | |
| Additive | | | | | | | | | | |

TABLE 15-continued

| Chromatic · Urethane Resin Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Plasticizer | Daihachi Chemical Industry Co., LTD | | | | | | | | | |
| Surface active agent | BYK-Chemie Japan K.K. | | | | | | | | | |
| Fluoro-modifier | Nippon Oil & Fats | | | | | | | | | |
| Silicone-modifier | Toagosei Chemical Industry | | | | | | | | | |
| Moisture remover | Kanegafuchi Chemical Industry | 0.5 | → | → | → | → | → | → | → | → |
| Dispersing agent | BYK-Chemie Japan K.K. | 0.5 | → | → | → | → | → | → | → | → |
| Wetting agent | BYK-Chemie Japan K.K. | | | | | | | | | |
| Consistency modifier | Kyoeisha Chemical Industry Co., LTD | 2 | → | → | → | → | → | → | → | → |
| Solvent | | | | | | | | | | |
| Toluene | | 10 | → | → | → | → | → | → | → | → |
| Butyl acetate | | 6 | → | → | → | → | → | → | → | → |
| Ethyl acetate | | 15 | → | → | → | → | → | → | → | → |
| Component B | | | | | | | | | | |
| Resin | | | | | | | | | | |
| Urethane | Takeda Chemical Industry | 13 | → | → | → | → | → | → | → | → |
| Hardening agent | | | | | | | | | | |
| Aliphatic amine A | Kanegafuchi Chemical Industry | | | | | | | | | |
| Aliphatic amine B | Mitsubishi Petrochemical | | | | | | | | | |
| Solvent | | | | | | | | | | |
| Butyl acetate | | 7 | → | → | → | → | → | → | → | → |
| Xylene | | | | | | | | | | |
| Colorant | | | | | | | | | | |
| Panastain | Fuji Toryo Co., Ltd. | 2 | → | → | → | → | → | → | → | → |
| Powder material | | | | | | | | | | |
| Reference | | | | | | | | | | |
| Calcite | 3 (New Mohs' hardness) | | | | | | | | | |
| Iron oxide | 4 (New Mohs' hardness) | | | | | | | | | |
| Glass powder | 5 (New Mohs' hardness) | | | | | | | | | |
| Example | | | | | | | | | | |
| Feldspar | 6 (New Mohs' hardness) | | | | | | | | | |
| Quartz | 7 (New Mohs' hardness) | | | | | | | | | |
| Zirconia | 11 (New Mohs' hardness) | | | | | | | | | |
| Alumina | 12 (New Mohs' hardness) | 4 | 26 | 23.5 | 52.5 | 64 | 78 | 96 | 118 | 146 |
| Silicon carbide | 13 (New Mohs' hardness) | | | | | | | | | |
| | | 5 | 25 | 30 | 40 | 45 | 50 | 55 | 60 | 65 |
| | | Volume concentration % | | | | | | | | |

TABLE 16

| Chromatic · Lacquer Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Component A | | | | | | | | | | |
| Resin | | | | | | | | | | |
| Silicone acrylate | Kanegafuchi Chemical Industry | | | | | | | | | |
| Acrylic B | Dainippon Ink & Chemicals | 4 | → | → | → | → | → | → | → | → |
| Fluoro | Asahi Glass | | | | | | | | | |
| Epoxy | Yuka Shell Epoxy Kabushiki Kaisha | | | | | | | | | |
| Alkyd | Dainippon Ink & Chemicals | 17 | → | → | → | → | → | → | → | → |
| Vinyl chloride | Union Carbide Corporation | | | | | | | | | |
| Nitrocellulose | Asahi Chemical Industry | 15 | → | → | → | → | → | → | → | → |
| Maleic | Arakawa Chemical Industries LTD | 8 | → | → | → | → | → | → | → | → |
| Additive | | | | | | | | | | |
| Plasticizer | Daihachi Chemical Industry Co., LTD | 4 | → | → | → | → | → | → | → | → |
| Surface active agent | BYK-Chemie Japan K.K. | | | | | | | | | |

TABLE 16-continued

| Chromatic · Lacquer Coating Formulation | | Volume concentration % | | | | | | | | |
|---|---|---|---|---|---|---|---|---|---|---|
| | | 5 | 25 | 30 | 40 | 45 | 50 | 55 | 60 | 65 |
| Fluoro-modifier | Nippon Oil & Fats | | | | | | | | | |
| Silicone-modifier | Toagosei Chemical Industry | | | | | | | | | |
| Moisture remover | Kanegafuchi Chemical Industry | | | | | | | | | |
| Dispersing agent | BYK-Chemie Japan K.K. | | | | | | | | | |
| Wetting agent | BYK-Chemie Japan K.K. | | | | | | | | | |
| Consistency modifier | Kyoeisha Chemical Industry Co., LTD | 2 | → | → | → | → | → | → | → | → |
| Solvent | | | | | | | | | | |
| Toluene | | 2 | → | → | → | → | → | → | → | → |
| Butanol | | 10 | → | → | → | → | → | → | → | → |
| Component B | | | | | | | | | | |
| Resin | | | | | | | | | | |
| Epoxy | Dainippon Ink & Chemicals | | | | | | | | | |
| Urethane | Takeda Chemical Industry | 1 | → | → | → | → | → | → | → | → |
| Hardening agent | | | | | | | | | | |
| Aliphatic amine A | Kanegafuchi Chemical Industry | | | | | | | | | |
| Aliphatic amine B | Mitsubishi Petrochemical | | | | | | | | | |
| Solvent | | | | | | | | | | |
| Butyl acetate | | 13 | → | → | → | → | → | → | → | → |
| Ethyl acetate | | 7 | → | → | → | → | → | → | → | → |
| Colorant | | | | | | | | | | |
| Panastain | Fuji Toryo Co., Ltd. | 2 | → | → | → | → | → | → | → | → |
| Powder material | | | | | | | | | | |
| Reference | | | | | | | | | | |
| Calcite | 3 (New Mohs' hardness) | | | | | | | | | |
| Iron oxide | 4 (New Mohs' hardness) | | | | | | | | | |
| Glass powder | 5 (New Mohs' hardness) | | | | | | | | | |
| Example | | | | | | | | | | |
| Feldspar | 6 (New Mohs' hardness) | | | | | | | | | |
| Quartz | 7 (New Mohs' hardness) | | | | | | | | | |
| Zirconia | 11 (New Mohs' hardness) | | | | | | | | | |
| Alumina | 12 (New Mohs' hardness) | 2.5 | 1.5 | 21.5 | 33.5 | 41 | 50 | 61.5 | 75 | 93 |
| Silicon carbide | 13 (New Mohs' hardness) | | | | | | | | | |
| | | 5 | 25 | 30 | 40 | 45 | 50 | 55 | 60 | 65 |
| | | Volume concentration % | | | | | | | | |

TABLE 17

| Shot values of pattern provided with a modified-paint film | Volume concentration % | | | | | | | | |
|---|---|---|---|---|---|---|---|---|---|
| | Chromatic | | | | | | | | |
| Coating | 0 | 5 | 25 | 30 | 45 | 50 | 55 | 60 | 65 |
| Epoxy-modified Acrylic resin | | | | | | | | | |
| Reference | | | | | | | | | |
| 3(New Mohs' hardness) | 300 | 200 | 150 | — | — | — | — | — | — |
| 4(New Mohs' hardness) | 300 | 200 | 150 | — | — | — | — | — | — |
| 5(New Mohs' hardness) | 300 | 250 | 200 | — | — | — | — | — | — |
| Example | | | | | | | | | |
| 6(New Mohs' hardness) | 300 | 500 | 600 | 750 | 850 | 950 | 1000 | 550 | 400 |
| 7(New Mohs' hardness) | 300 | 500 | 600 | 750 | 850 | 950 | 1000 | 600 | 400 |
| 11(New Mohs' hardness) | 300 | 500 | 600 | 750 | 850 | 1000 | 1000 | 700 | 450 |
| 12(New Mohs' hardness) | 300 | 550 | 650 | 750 | 900 | 1050 | 1250 | 750 | 500 |
| 13(New Mohs' hardness) | 300 | 550 | 700 | 900 | 900 | 1080 | 1300 | 500 | 350 |
| Silicone acrylate resin | | | | | | | | | |

TABLE 17-continued

| Shot values of pattern provided with a modified-paint film | | | | | | | | | |
|---|---|---|---|---|---|---|---|---|---|
| | Volume concentration % | | | | | | | | |
| Reference | | | | | | | | | |
| 3(New Mohs' hardness) | 300 | 200 | 150 | — | — | — | — | — | — |
| 4(New Mohs' hardness) | 300 | 200 | 150 | — | — | — | — | — | — |
| 5(New Mohs' hardness) | 300 | 250 | 200 | — | — | — | — | — | — |
| Example | | | | | | | | | |
| 6(New Mohs' hardness) | 300 | 500 | 600 | 750 | 850 | 950 | 1050 | 550 | 400 |
| 7(New Mohs' hardness) | 300 | 500 | 600 | 750 | 850 | 950 | 1000 | 650 | 400 |
| 11(New Mohs' hardness) | 300 | 500 | 600 | 750 | 900 | 1000 | 1100 | 700 | 450 |
| 12(New Mohs' hardness) | 300 | 580 | 750 | 900 | 950 | 1050 | 1250 | 750 | 450 |
| 13(New Mohs' hardness) | 300 | 580 | 800 | 900 | 950 | 1100 | 1300 | 500 | 350 |

| | Achromatic | | | | | | | | |
|---|---|---|---|---|---|---|---|---|---|
| Coating | 0 | 5 | 25 | 30 | 45 | 50 | 55 | 60 | 65 |
| Epoxy-modified Acrylic resin | | | | | | | | | |
| Reference | | | | | | | | | |
| 3(New Mohs' hardness) | 200 | 250 | 280 | 200 | 100 | — | — | — | — |
| 4(New Mohs' hardness) | 200 | 250 | 280 | 200 | 80 | — | — | — | — |
| 5(New Mohs' hardness) | 200 | 300 | 280 | 250 | 100 | — | — | — | — |
| Example | | | | | | | | | |
| 6(New Mohs' hardness) | 200 | 450 | 650 | 750 | 950 | 1100 | 1250 | 550 | 400 |
| 7(New Mohs' hardness) | 200 | 450 | 650 | 750 | 950 | 1100 | 1250 | 600 | 400 |
| 11(New Mohs' hardness) | 200 | 500 | 700 | 850 | 1000 | 1200 | 1350 | 700 | 450 |
| 12(New Mohs' hardness) | 200 | 550 | 750 | 850 | 1250 | 1450 | 1500 | 750 | 500 |
| 13(New Mohs' hardness) | 200 | 550 | 800 | 980 | 1250 | 1500 | 1550 | 500 | 350 |
| Silicone acrylate resin | | | | | | | | | |
| Reference | | | | | | | | | |
| 3(New Mohs' hardness) | 100 | 250 | 280 | 280 | 100 | — | — | — | — |
| 4(New Mohs' hardness) | 100 | 250 | 280 | 200 | 50 | — | — | — | — |
| 5(New Mohs' hardness) | 100 | 280 | 300 | 200 | 100 | — | — | — | — |
| Example | | | | | | | | | |
| 6(New Mohs' hardness) | 100 | 450 | 650 | 750 | 950 | 1100 | 1250 | 600 | 400 |
| 7(New Mohs' hardness) | 100 | 450 | 650 | 750 | 950 | 1100 | 1250 | 650 | 400 |
| 11(New Mohs' hardness) | 100 | 550 | 700 | 850 | 1000 | 1250 | 1400 | 750 | 450 |
| 12(New Mohs' hardness) | 100 | 580 | 750 | 880 | 1250 | 1480 | 1550 | 800 | 450 |
| 13(New Mohs' hardness) | 100 | 580 | 800 | 1000 | 1300 | 1500 | 1580 | 700 | 350 |

TABLE 18

| Shot values of pattern provided with a non-modified-paint film | | | | | | | | | |
|---|---|---|---|---|---|---|---|---|---|
| | Volume concentration % | | | | | | | | |
| | Chromatic | | | | | | | | |
| Coating | 0 | 5 | 25 | 30 | 45 | 50 | 55 | 60 | 65 |
| Epoxy-modified Acrylic resin | | | | | | | | | |
| Reference | | | | | | | | | |
| 3(New Mohs' hardness) | 150 | 200 | 150 | — | — | — | — | — | — |
| 4(New Mohs' hardness) | 150 | 200 | 130 | — | — | — | — | — | — |
| 5(New Mohs' hardness) | 150 | 250 | 200 | — | — | — | — | — | — |
| Example | | | | | | | | | |
| 6(New Mohs' hardness) | 150 | 300 | 450 | 550 | 650 | 700 | 750 | | 450 |
| 7(New Mohs' hardness) | 150 | 300 | 450 | 550 | 650 | 750 | 780 | | 450 |
| 11(New Mohs' hardness) | 150 | 350 | 500 | 550 | 750 | 800 | 800 | | 400 |
| 12(New Mohs' hardness) | 150 | 350 | 550 | 650 | 870 | 900 | 950 | | 400 |
| 13(New Mohs' hardness) | 150 | 350 | 550 | 680 | 900 | 950 | 1000 | | 350 |
| Silicone acrylate resin | | | | | | | | | |
| Reference | | | | | | | | | |

TABLE 18-continued

| | Shot values of pattern provided with a non-modified-paint film | | | | | | | | |
|---|---|---|---|---|---|---|---|---|---|
| | Volume concentration % | | | | | | | | |
| 3(New Mohs' hardness) | 150 | 150 | 150 | — | — | — | — | — | — |
| 4(New Mohs' hardness) | 150 | 150 | 130 | — | — | — | — | — | — |
| 5(New Mohs' hardness) | 150 | 250 | 200 | — | — | — | — | — | — |
| Example | | | | | | | | | |
| 6(New Mohs' hardness) | 150 | 300 | 500 | 550 | 650 | 700 | 750 | | 450 |
| 7(New Mohs' hardness) | 150 | 300 | 500 | 550 | 650 | 700 | 780 | | 450 |
| 11(New Mohs' hardness) | 150 | 300 | 500 | 550 | 700 | 750 | 800 | | 400 |
| 12(New Mohs' hardness) | 150 | 350 | 550 | 620 | 830 | 900 | 980 | | 400 |
| 13(New Mohs' hardness) | 150 | 350 | 600 | 680 | 870 | 950 | 1030 | | 350 |
| | Achromatic | | | | | | | | |
| Coating | 0 | 5 | 25 | 30 | 45 | 50 | 55 | 60 | 65 |
| Epoxy-modified Acrylic resin | | | | | | | | | |
| Reference | | | | | | | | | |
| 3(New Mohs' hardness) | 100 | 100 | 200 | 150 | 100 | — | — | — | — |
| 4(New Mohs' hardness) | 100 | 150 | 200 | 150 | 80 | — | — | — | — |
| 5(New Mohs' hardness) | 100 | 200 | 250 | 150 | 80 | — | — | — | — |
| Example | | | | | | | | | |
| 6(New Mohs' hardness) | 100 | 300 | 550 | 600 | 750 | 800 | 900 | | 450 |
| 7(New Mohs' hardness) | 100 | 300 | 550 | 600 | 750 | 800 | 920 | | 450 |
| 11(New Mohs' hardness) | 100 | 350 | 550 | 600 | 750 | 850 | 950 | | 400 |
| 12(New Mohs' hardness) | 100 | 350 | 650 | 700 | 900 | 1000 | 1100 | | 400 |
| 13(New Mohs' hardness) | 100 | 350 | 700 | 750 | 900 | 1000 | 1200 | | 350 |
| Silicone acrylate resin | | | | | | | | | |
| Reference | | | | | | | | | |
| 3(New Mohs' hardness) | 100 | 200 | 250 | 150 | 100 | — | — | — | — |
| 4(New Mohs' hardness) | 100 | 200 | 250 | 130 | 80 | — | — | — | — |
| 5(New Mohs' hardness) | 100 | 250 | 300 | 200 | 100 | — | — | — | — |
| Example | | | | | | | | | |
| 6(New Mohs' hardness) | 100 | 400 | 600 | 630 | 750 | 800 | 900 | | 450 |
| 7(New Mohs' hardness) | 100 | 400 | 600 | 630 | 750 | 800 | 920 | | 450 |
| 11(New Mohs' hardness) | 100 | 400 | 600 | 630 | 750 | 850 | 1000 | | 400 |
| 12(New Mohs' hardness) | 100 | 450 | 700 | 750 | 920 | 1000 | 1150 | | 400 |
| 13(New Mohs' hardness) | 100 | 450 | 750 | 800 | 920 | 1050 | 1200 | | 350 |

TABLE 19

| | Shot values of pattern provided with a non-modified-paint film | | | | | | | | | | | | | | | | | |
|---|---|---|---|---|---|---|---|---|---|---|---|---|---|---|---|---|---|---|
| | Volume concentration % | | | | | | | | | | | | | | | | | |
| | Chromatic | | | | | | | | | Achromatic | | | | | | | | |
| Coating | 0 | 5 | 25 | 30 | 45 | 50 | 55 | 60 | 65 | 0 | 5 | 25 | 30 | 45 | 50 | 55 | 60 | 65 |
| Fluoro 12(New Mohs' hardness) | 150 | 200 | 450 | | 750 | 800 | 830 | | | 200 | 350 | 550 | | 800 | 850 | 950 | | |
| Lacquer alkyd 12(New Mohs' hardness) | 100 | 150 | 300 | | 200 | 250 | 250 | | | 70 | 150 | 200 | | 250 | 300 | 300 | | |
| Urethane 12(New Mohs' hardness) | 200 | 250 | 200 | | 400 | 500 | 600 | | | 100 | 200 | 250 | | 450 | 550 | 750 | | |

Patterns for the sandmold production of this invention differ in their performance from patterns on which coatings containing conventional shellac or a mold releasing agent are applied. Namely, the patterns of this invention can bear the repeated impact of the casting sand, and also can bear the friction from the casting sand due to the mechanical vibration of the molding machine. Therefore, the abrasion resistant pattern of this invention can be used in the sandmold production for a long time, and will be useful in lowering the costs of casting.

Further, the damages to the surfaces of the patterns can be easily repaired by re-coating. When various colorants are added in coatings, the time necessary to repair the paint film, namely, the surface layer of the pattern, is determined. Further, the production of the sandmolds having various purposes can be classified by using the colored patterns of this invention. For instance, a red pattern can be used for indicating the production of a piston rod and a blue pattern for a crank.

As mentioned above, since this invention provides a pattern, on the surface of which the paint film containing various types of powder materials is applied, resistance against the powder friction of the casting sand is given to the pattern, thereby increasing the number of shots that can be produced in the sandmold, and leading to lower casting costs.

We claim:

1. An improved construction for a pattern member for the repetitive impact forming of casting molds from silica base casting sand of abrasive character, comprising a rigid base member having a selectively shaped surface portion adapted to be compressively displaced into an unformed mass of casting sand to form a sand mold having a surface complemental to that of said selectively shaped surface portion, said selectively shaped surface portion of said base member having a thin continuous abrasion resistant coating adhesively disposed thereon and formed of the dry residue of a resinous carrier film having uniformly dispersed therein at least about 5% to 65% by volume of finely divided particulate material of a New Mohs' hardness in excess of that of the casting sand and of a minimum New Mohs' hardness of at least 6 for interposed interfacial contact with said casting sand in the formation of sand molds therefrom.

2. The improved construction for a pattern member as set forth in claim 1 wherein the resinous carrier includes a resin selected from the group consisting of nitrocellulose, epoxy, acrylic, urethane, silicone acrylate, fluoro resin, alkyd, phenol, vinyl and maleic.

3. The improved construction for a pattern member as set forth in claim 1 wherein the finely divided particulate material is selected from the group consisting of feldspar, quartz, zirconia, alumina and silicon carbide.

4. The improved construction for a pattern member as set forth in claim 1 wherein the particle size of the particulate material dispersed in said carrier film is about 65 microns or less.

5. The improved construction for a pattern member as set forth in claim 1 wherein the carrier film contains a colorant.

6. The improved construction for a pattern member as set forth in claim 1 wherein the carrier film contains about 2%, by weight, of a colorant.

* * * * *